United States Patent [19]

Nordholm et al.

[11] Patent Number: 4,978,946

[45] Date of Patent: Dec. 18, 1990

[54] PERSONAL SECURITY COMMUNICATION SYSTEM

[75] Inventors: Ken Nordholm; H. I. Eyers, both of Vancouver, Canada

[73] Assignee: Talkie Tooter (Canada) Ltd., Vancouver, Canada

[21] Appl. No.: 326,716

[22] Filed: Mar. 21, 1989

Related U.S. Application Data

[63] Continuation-in-part of Ser. No. 84,959, Aug. 13, 1987, Pat. No. 4,884,067.

[51] Int. Cl.[5] ..... G08B 21/00

[52] U.S. Cl. ..... 340/573; 340/309.15; 340/539

[58] Field of Search ..... 340/573, 539, 309.15

[56] References Cited

U.S. PATENT DOCUMENTS

| | | | |
|---|---|---|---|
| 3,588,858 | 6/1971 | Demuth | 340/573 |
| 3,631,433 | 12/1971 | Dix | 340/509 |
| 3,668,526 | 6/1972 | Raskin | 340/539 |
| 4,121,160 | 10/1978 | Cataldo | 340/321 |
| 4,218,763 | 8/1980 | Kelley et al. | 340/539 |
| 4,331,953 | 5/1982 | Blevins et al. | 340/539 |
| 4,418,337 | 11/1983 | Bader | 340/571 |
| 4,468,656 | 8/1984 | Clifford et al. | 34/539 |
| 4,507,654 | 3/1985 | Stolarczyk et al. | 340/545 |
| 4,524,243 | 6/1985 | Shapiro | 340/573 |
| 4,665,385 | 5/1987 | Henderson | 340/539 |
| 4,667,188 | 5/1987 | Schwartz | 340/689 |
| 4,736,196 | 4/1988 | McMahon et al. | 340/573 |

*Primary Examiner*—Glen R. Swann, III

*Attorney, Agent, or Firm*—Christensen, O'Connor, Johnson & Kindness

[57] ABSTRACT

A personal security communication system provides an indication that a worker may be incapacitated. The system may be configured as a buddy system comprising first and second portable units (100 and 200) acting as a pair (98). Each portable unit (100 and 200) produces status information and transmits data messages containing encoded status information to the other portable unit (200 and 100). The encoded status information includes a transmitting unit indentification number and alarm condition information produced by manual alarm switches (104 and 204) and sensors (102 and 202). The sensors (1102 and 202) may include a motion sensor (45) or a motion and position sensing switch (10) that produce motion and lack-of-motion signals that are encoded in the status information. If one unit of the pair (98) produces status information containing emergency alarm information or receives a data message from the other unit of the pair (98) containing emergency alarm information or fails to receive a data message from the other unit of the pair (98) within a predetermined time limit, an alarm is produced.

28 Claims, 11 Drawing Sheets

PERSONAL SECURITY COMMUNICATION SYSTEM

CROSS-REFERENCE TO RELATED APPLICATIONS

This application is a continuation-in-part of U.S. Ser. No. 084,959, filed Aug. 13, 1987, U.S. Pat. No. 4,884,067, and entitled "Motion and Position Sensing Alarm."

FIELD OF THE INVENTION

This invention relates to personal security communication systems and more particularly to motion sensing alarms and motion and position sensors.

DESCRIPTION OF THE PRIOR ART

A number of occupations wherein workers are isolated and working in dangerous environments require that the workers be continuously monitored. For example, a security guard making his rounds on the premises of a building may be required to inform a central office of his whereabouts.

Within the forest industry, the forest workers face similar dangers. A buddy system for monitoring workers' status is used extensively. Prior art buddy systems usually require a worker to occasionally stop working and physically monitor the work of his partner. The major shortcoming of these prior art systems is that an emergency situation is only detected when the buddy stops work to monitor the situation, and accordingly, productivity is affected by requiring the workers to pause periodically.

In another prior art buddy system, the workers are in a group with one member whose sole responsibility is to detect if any member of the group is in need of assistance. This is usually accomplished by having this member move from one worker to the next and verifying that all is well within the group. In these situations, the group productivity is limited because one member of the group is not able to work continuously.

Another prior art buddy system utilizes two-way voice radios permitting a worker to communicate with his buddy. When one worker is in need of assistance, that worker can use his radio to call his partner for help. One problem associated with this prior art system is that if the worker in need of assistance becomes disabled (e.g., unconscious) he may not be able to call his partner. Another problem associated with the prior art buddy systems is their lack of a fail-safe feature. That is, when either one of the radios becomes nonfunctional, such as when a radio is broken or out of range, a worker's call for assistance will not be received by his partner. Thus, a communication failure between the radios will prevent an emergency call from being heeded by the partner.

As can be readily appreciated from the foregoing discussion, there is a need for a buddy communication system that automatically communicates worker status information between radio units. Further, the buddy communication system should have a fail-safe feature, such that a failure to receive status information for a predetermined period of time causes a "communication failure" alarm. The present invention is a personal security system designed to achieve these results.

SUMMARY OF THE INVENTION

In accordance with the present invention, a personal security system configured to operate as a buddy system is provided. The system includes a first portable unit that produces a first status signal and a second portable unit that produces a second status signal. The first portable unit receives the second status signal and produces an alarm when the first status signal or the second status signal includes emergency alarm information or when the second status signal is not received for a predetermined period of time. The second portable unit receives the first status signal and produces an alarm when the first status signal or the second status signal includes emergency alarm information or when the first status signal is not received for a predetermined period of time.

In accordance with further aspects of the present invention, the first and second portable units include manual alarm switches and motion sensors. The manual alarm switches produce manual alarm signals when activated and cause the first and second portable units to produce first and second status signals that include emergency alarm information related to the manual alarm signals. The motion sensors produce motion sensor signals in response to movement of the first and second portable units. Transmit timers cause the first and second portable units to transmit the first and second status signals at regular intervals. Motion timers time the interval between consecutive motion sensor signals. When the interval exceeds a predetermined time interval, the first and second portable units produce status signals including emergency alarm information indicating lack of motion of the first and second portable units. Message timers time the interval between transmitted data messages. When the interval between data messages exceeds a predetermined time interval, the first and second portable units produce status signals including emergency alarm information indicating a communication failure between the first and second portable units.

In accordance with still further aspects of the present invention, there is provided a unit for use in a personal security system. The unit comprises: at least one signaling device, a processor, a transmitter, an alarm, and a power supply. The processor receives and encodes signal information from the at least one signaling device and produces a status signal indicative of the signal information. The processor further produces an alarm signal when the status signals includes emergency alarm information. The transmitter transmits the status signals as a data message. The alarm signal is applied to the alarm. The power supply provides power to the processor, the transmitter and the alarm.

BRIEF DESCRIPTION OF THE DRAWINGS

Particular embodiments of the invention will be understood in conjunction with the accompanying drawings in which.

DESCRIPTION OF THE PREFERRED EMBODIMENTS

Figure 1:
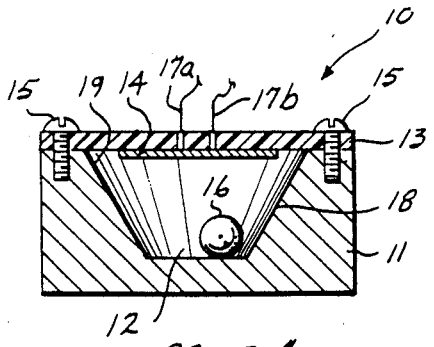
FIG. 1 is a sectional view of a motion and position sensing switch.

Referring now to FIG. 1, we have shown, generally at reference numeral 10, a sectional view of a motion and position sensing switch. When placed in a horizontal position, the switch is in the off state.

The motion and position sensing switch is comprised of an electrically conductive enclosure 11 having a truncated cone-shaped cavity 12. It will be understood by those knowledgeable in this art that cavity 12 may have other shapes as well. Enclosure 11 and cavity 12 are capped by means of a plate 13 having a conductive circuit 14, electrically isolated from enclosure 11. Plate 13 is secured onto enclosure 11 by means of fasteners 15 which can consist of self-tapping screws and the like. A conductive ball 16 is used as a contact making element between conductive enclosure 11 and conductive circuit 14.

A pair of conductors 17*a* and 17*b* can be connected to a suitable detecting circuit (not shown) adapted to monitor the change of state of switch 10. The interior edge 18 of cavity 12 makes an angle of 30° from a vertical axis. When switch 10 pivots about the horizontal axis to an angle greater than 60° from the vertical axis, conductive ball 16 rolls to the outer edge 19 of cavity 12, thereby allowing contact to be made between enclosure 11 and conductive circuit 14. (See FIG. 2). In this position, switch 10 now turns to an active state since current is allowed to flow from enclosure 11 to conductive circuit 14 and to a detecting circuit via conductor 17*a* and 17*b*.

Figure 2:
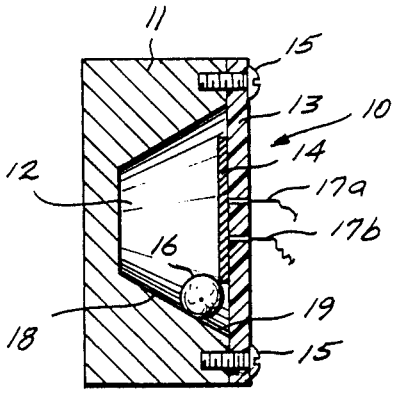
FIG. 2 is a sectional view of the sensing switch of FIG. 1 shown pivoted from a horizontal to a vertical position.
Figure 3:
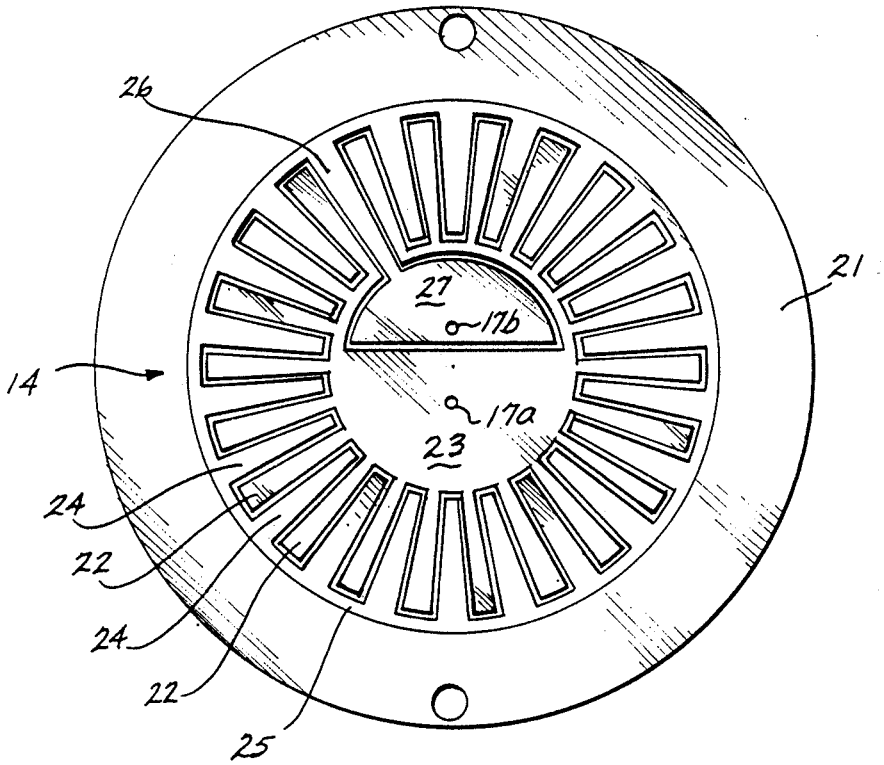
FIG. 3 is a top view of a conductive circuit used with the sensing switch of FIG. 1.

Referring now to FIG. 3, we have shown a top view of the conductive circuit shown at reference numeral 14 of FIGS. 1 and 2. Conductive circuit 14 is comprised of a gold-plated circuit etched on a nonconductive surface 21. In the present embodiment, conductive circuit 14 forms two separate electrical conductive regions. These regions are comprised of a first set of conductive lines or fingers 22 extending outwardly from a central conductive region 23. Each finger is positioned radially in spaced relationship. A second set of lines or fingers 24 extend inwardly from a peripheral conductive ring 25 located outwardly from the first set of lines 22. The second set of lines 24 are positioned radially in spaced relationship adjacent to the first set of lines 22. A separate conductive line 26 is used to connect conductive ring 25 to a central conductive region 27 lying adjacent to conductive region 23. The first and second set of lines are electrically isolated from one another. Conductive regions 23 and 27 are individually connected to a detecting circuit (not shown) by means of conductors 17*a* and 17*b*, respectively.

Conductive circuit 14 allows switch 10 to provide, while in the active state, three possible electrical state changes. For example, conductive ball 16 can make electrical contact between enclosure 11 and conductive fingers 22, between enclosure 11 and conductive fingers 24 and between enclosure 11 and conductive fingers 22 and 24. That is, the conductive ball 16 can make contact with fingers 22, 24 or both.

Similarly, conductive circuit 14 could be designed with a single set of conductive fingers separated by nonconductive fingers, thereby allowing a detecting circuit to detect a change of state of the motion sensing switch. It will be understood by those knowledgeable in this art that other circuit designs can be used to arrive at the same results without departing from the scope of the invention.

Figure 4:
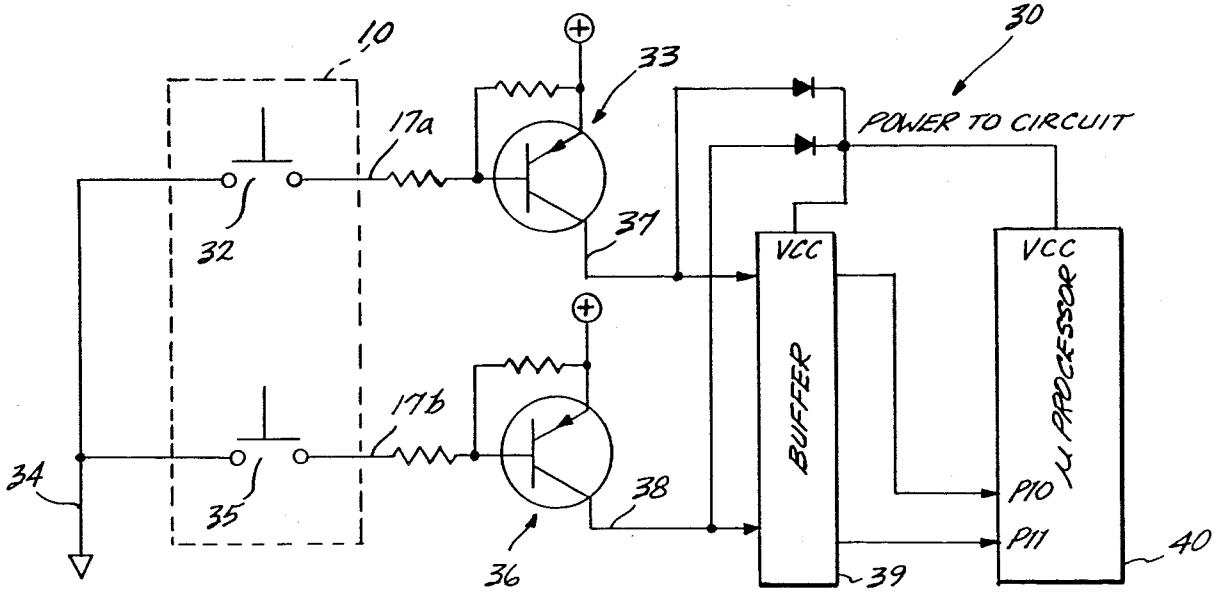
FIG. 4 is a block diagram of a motion sensor circuit using the motion and position sensing switch.

Referring now to FIG. 4, a block diagram of a motion sensor circuit is depicted at reference numeral 30. The motion sensing switch is depicted by circuit 10 defined by the dotted line. Switch 32 represents the opening and closing of electrical contact made by the conductive ball between enclosure 11 and fingers 22. Conductor 17*a* leads from switch 10 to a transistor switching circuit 33. Enclosure 11 is connected to ground by means of conductor 34 which is not shown in FIGS. 1 and 2 for the sake of clarity. Switch 35 represents the opening and closing of electrical contact made by conductive ball 16 between enclosure 11 and fingers 24. Conductor 17*b* connects conductive region 27 to transistor switching circuit 36.

The collectors 37 and 38 from the transistor switching circuit 33 and 36 are connected to a buffer circuit 39. The output of the buffer circuit is then connected to a microprocessor 40.

The microprocessor 40 monitors the production and negation of signals established by switching circuits 33 and 36. Whenever the microprocessor detects a change of state created by switch 32 and 35, i.e., switch 32 open, switch 35 closed, switch 32 closed, switch 35 open or switch 32 and 35 closed, an internal timer (not shown) is reset and activated. However, if the timer reaches a preset value before a change of state is detected, then an alarm signal is produced. This would occur, for example, if conductive ball 16 remained motionless making contact between enclosure 11 and conductive circuit 14.

In another embodiment, motion sensing switch 10 could be made of a non-conductive enclosure and provided with a conductive region near the outer edge of the cavity, such that when the contact making element moves to the outer edge of the cavity, contact is made between ground and the conductive circuit.

Figure 5:
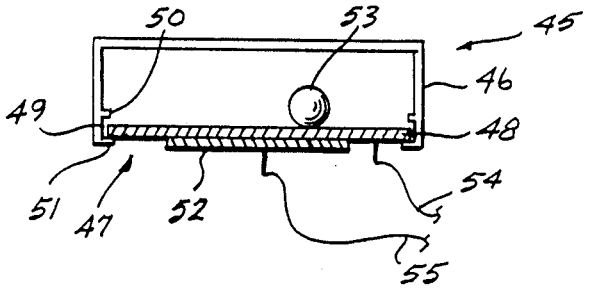
FIG. 5 is a sectional view of a second type of motion sensor.

Referring now to FIG. 5, we have shown at reference numeral 45 a sectional view of a motion sensor according to another embodiment of the present invention. The sensor is comprised of an enclosure 46 having an open end shown generally at reference numeral 47 which is covered by means of a base 48 and secured therein by means of a channel 49 formed by a pair of ridges 50 and 51.

Base 48 is provided with a pressure sensitive electrical sensor 52 which can consists of a piezoelectric element. A motion sensitive weight, such as ball bearing 53, is retained within enclosure 46 and can freely move therein. Leads 54 and 55 are connected to a detection circuit adapted to monitor any electrical impulses generated which are indicative of the motion of ball bearing 53 on base 48.

Such a sensor, because of its ruggedness and simplicity, is well suited for applications in the logging industry.

Figure 6:
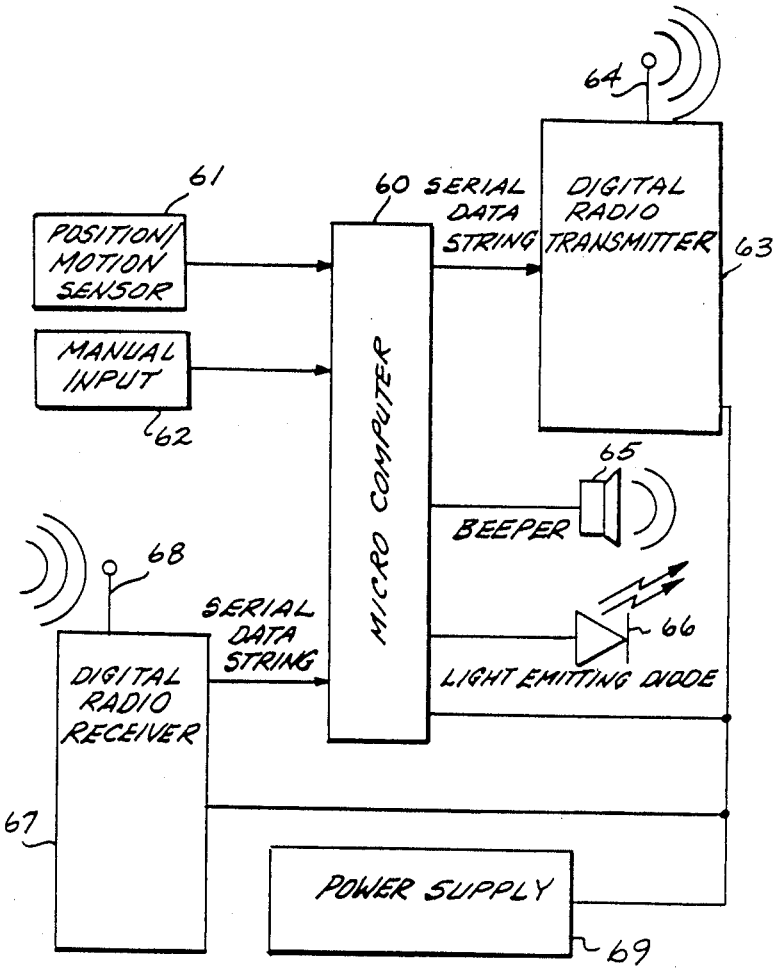
FIG. 6 is a block diagram of a personal security communication system using a position/motion sensor.

Referring now to FIG. 6, we have shown a block diagram of one embodiment of a personal security communication system formed in accordance with the present invention. While the system illustrated in FIG. 6 and discussed below utilizes a position/motion sensor 61, it is to be understood that the system may utilize other types of sensing devices, such as a gas detector or a heart monitor, for example. Furthermore, the system may utilize more than one sensing device or no sensing device.

In this system, the microcomputer 60 is the heart of the system. In the particular embodiment illustrated in FIG. 6, the microcomputer 60 is responsible for monitoring the status of the user by means of the position/-motion sensor 61 or manual input 62. Manual input 62 is basically comprised of a switch which is activatable by the user when an alarm condition exists. If, however, the user has become disabled, the position and motion sensor 61 can detect the existence of an alarm condition. If an alarm condition exists, microcomputer 60 will generate a message in the form of a digital signal which is transmitted through a radio transmitter 63 via antenna 64 to other units in the system or to a central station. When an emergency condition exists, microcomputer 60 also activates a signaling means such as beeper 65 and/or light emitting diode 66 forming part of each unit. A digital radio receiver 67 and receiving antenna 68 are provided with each unit. The microcomputer 60 listens to the signal provided by radio receiver 67 for messages coming from other units or from a base station. Computer 60 controls the beeper 65 and light emitting diode 66 to display the status of the system.

The microcomputer 60 may consist of, but is not limited to, an Intel 8051 microcontroller and external, single component EPROM memory chip. The radio transmitter 63 and receiver 67 are capable of transmitting and receiving a digital data message. The on/off keying and modulation of the transmitter 63 can be controlled by microcomputer 60. The receiver 67 will normally be on, and turned off during transmission. The power supply 69 is used to provide power to radio transmitter 63, receiver 67, microcomputer 60, beeper 65 and light emitting diode 66. The power supply can consist of a Nicad rechargeable battery pack. The system can be enclosed in a small housing and belt mounted.

The system can be configured with two units operating in a buddy system, wherein each unit monitors the other's status or in a group system, wherein the status of all the working units is monitored from a base station.

Figure 7:
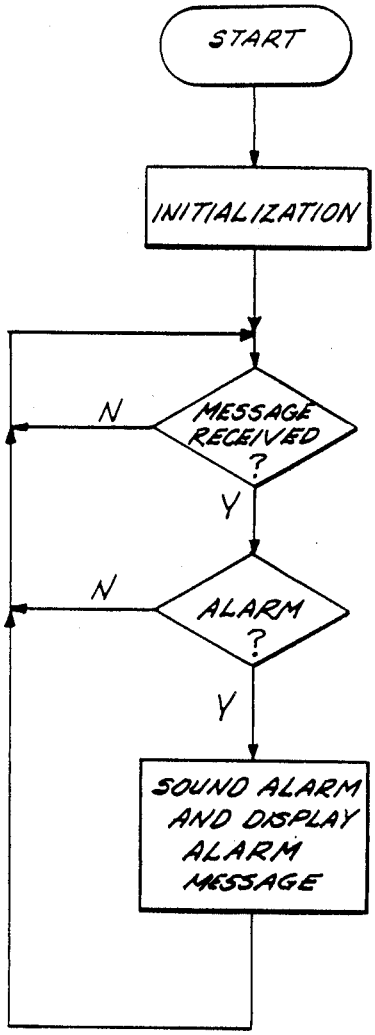
FIG. 7 is a flow chart for a nonpolling base station.
Figure 8:
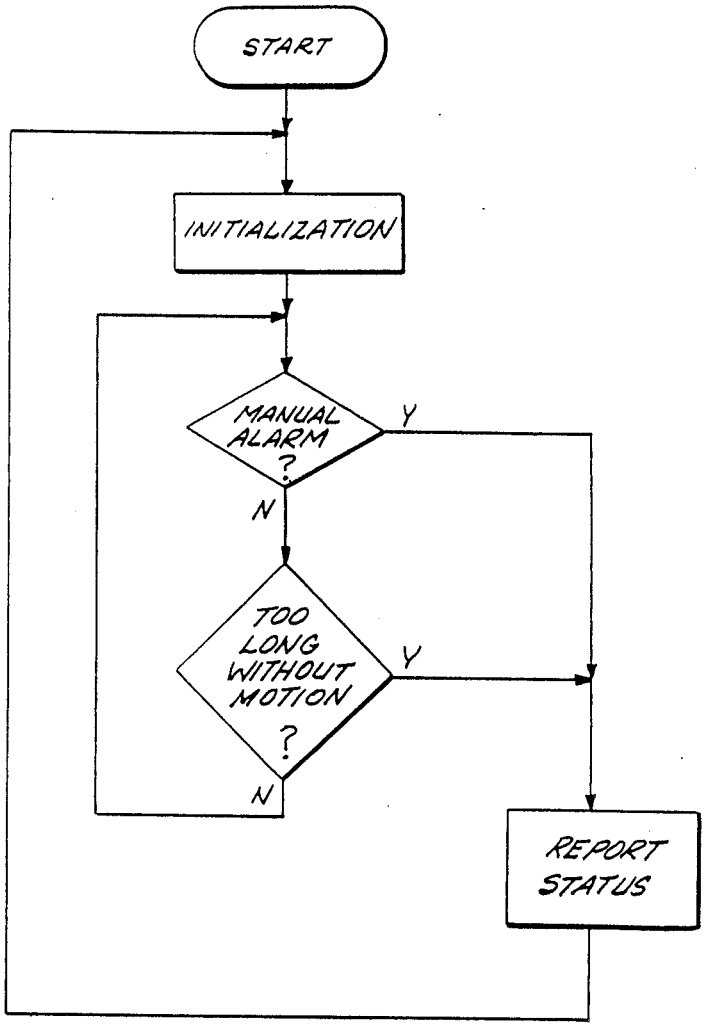
FIG. 8 is a flow chart for the portable units used in a nonpolling network.

As indicated above, different modes of operation are possible using the present system. For example, in a nonpolling network, each user would carry a unit having only the transmitter rather than both transmitter and receiver. The transmitter would be activated upon occurrence of an alarm condition. A signal would then be transmitted to a base station which would monitor all transmissions from each unit in the field. The information flow charts for the base station and a unit are shown in FIGS. 7 and 8, respectively.

Figure 9:
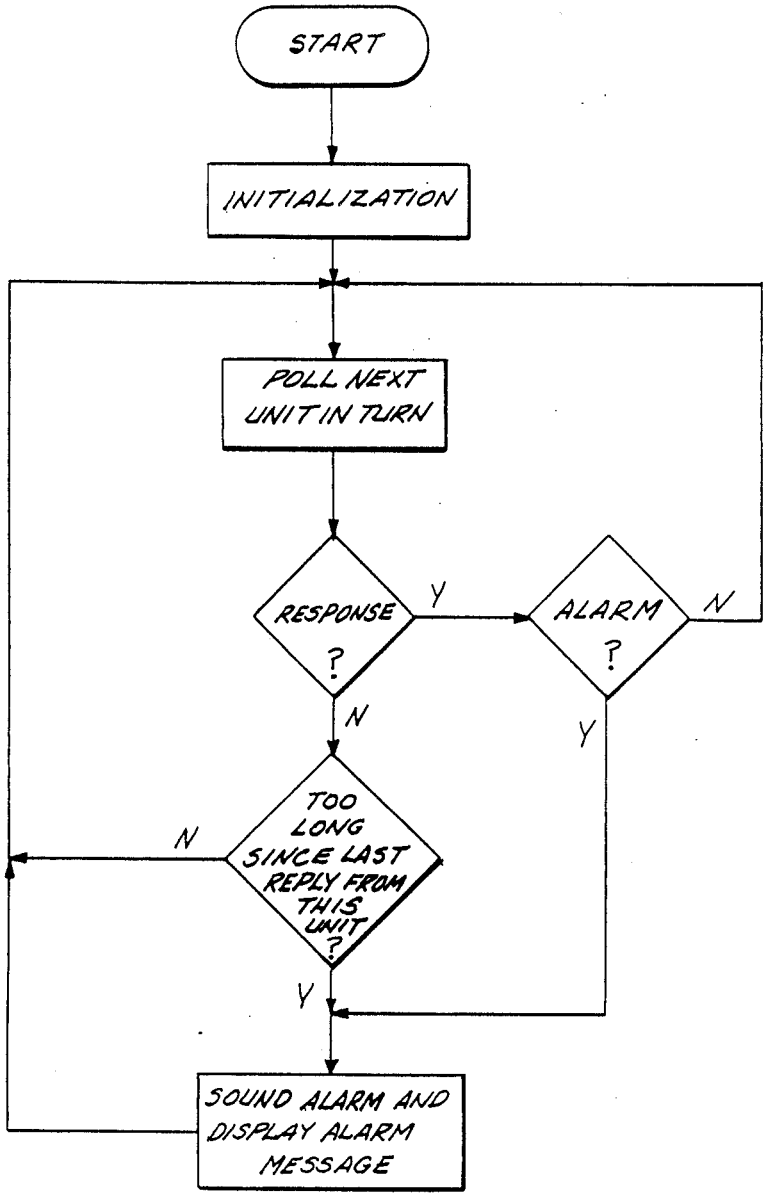
FIG. 9 is a flow chart for a polling base station.
Figure 10:
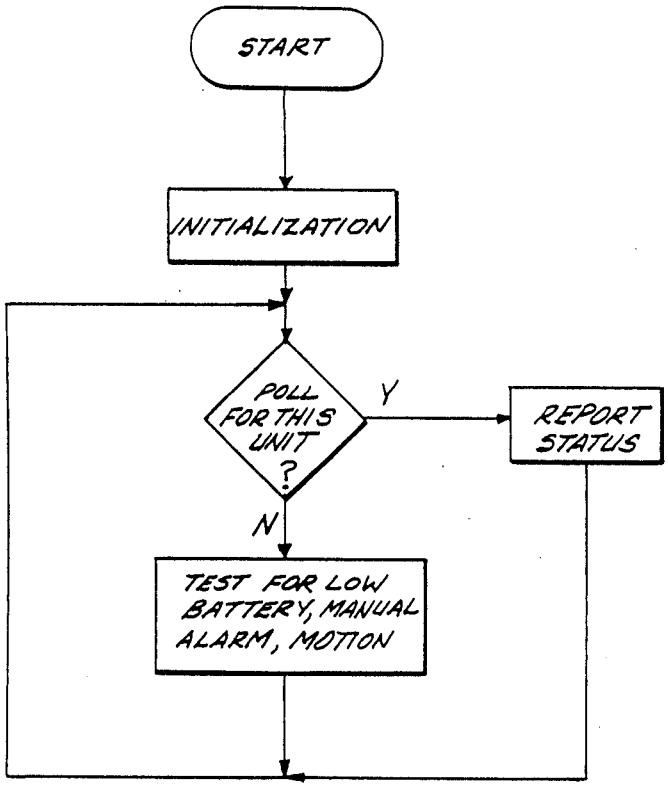
FIG. 10 is a flow chart for portable units used in a polling network.

The communication system may also operate in a polling network, wherein each unit worn by a worker in a group of workers is provided with a transmitter and a receiver. A base station will continuously poll the status of each individual. For example, the base station will poll a first portable unit and await a response prior to polling a second portable unit. If no response is received after a specified time, the alarm will be activated. The information flow chart for the base station is shown in FIG. 9. The information flow chart for the portable units is depicted in FIG. 10.

As indicated above, the personal security communication system may also be configured as a buddy system. In a buddy system configuration, two portable units work as a pair. The portable units are bilateral, such that each unit includes a receiver and transmitter, preferably, in the form of a transceiver. As will become better understood from the following discussion, each portable unit transmits encoded status signals in the form of a data message, such as a digital data message, for example, to the other unit in the pair. More specifically, the portable units transmit encoded status signals as a radio frequency carrier signal modulated with data messages. The data message is transmitted continuously at regular intervals. As will also become better understood from the following discussion, the encoded status information in each message includes a transmitting unit identification number and alarm state information. The other unit of the pair receives the data message and alerts a worker wearing the receiving unit if the alarm state information indicates an emergency alarm condition exists at the transmitting unit. The receiving unit also alerts the worker of an out-of-range or malfunctioning transmitting or receiving unit when a data message is not received for a predetermined period of time (i.e., a communication failure alarm).

Figure 11:
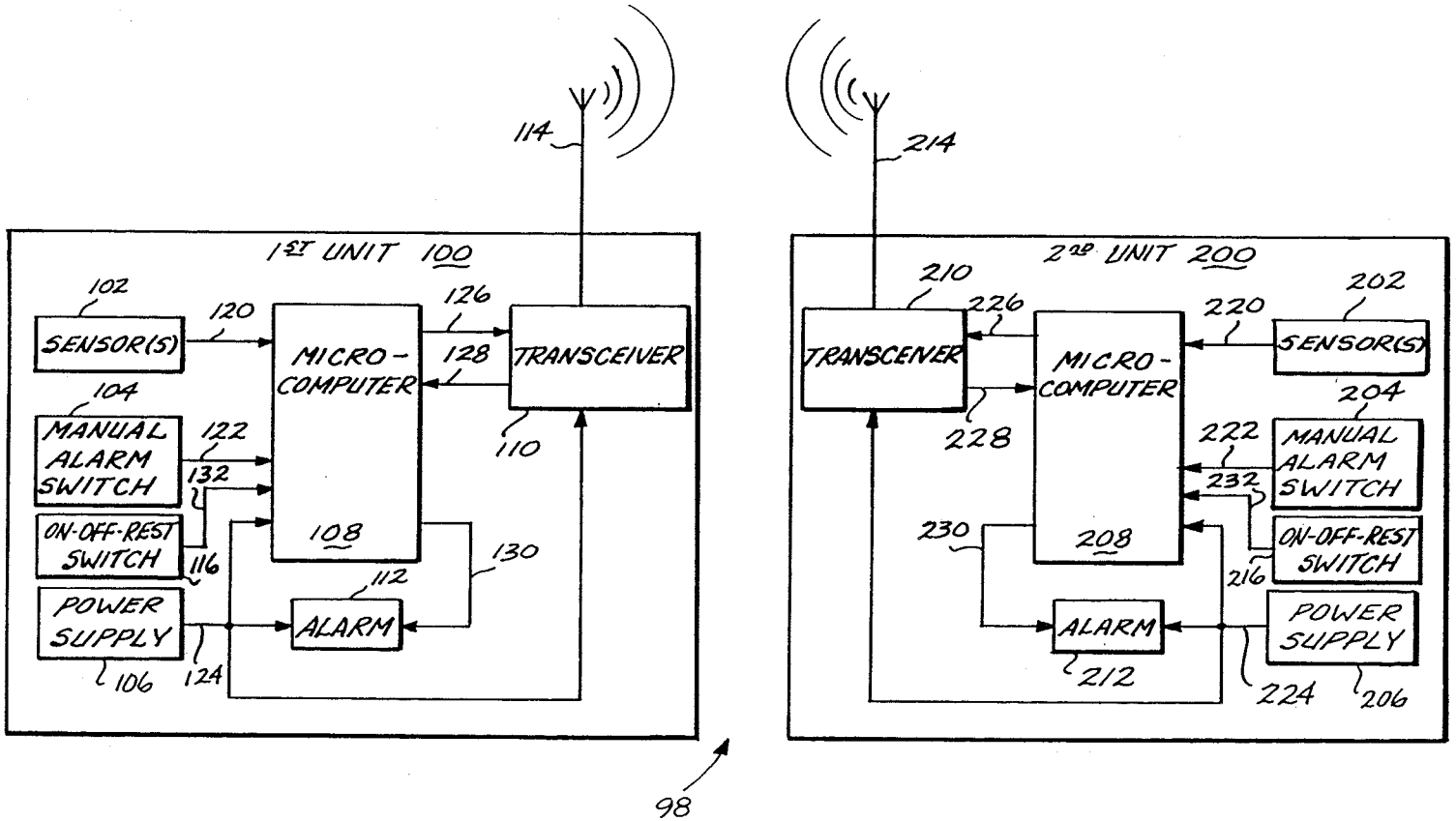
FIG. 11 is a block diagram of the personal security communication system in a buddy system configuration.

FIG. 11 is a block diagram of a preferred embodiment of the personal security communication system configured as a buddy system. A first portable unit 100 and a second portable unit 200 operate as a unit pair 98. The first portable unit 100 comprises: one or more sensors 102, a manual alarm switch 104, a power supply 106, a microcomputer 108, a digital transceiver 110, an alarm 112, an ON-OFF-REST switch 116, and an antenna 114. The power supply 106 provides power to the microcomputer 108, transceiver 110, and the alarm 112 via line 124. The microcomputer 108 receives sensor input signals from the sensors 102 via line 120 and a manual alarm input signal from the manual alarm switch 104 via line 122. The microcomputer 108, in turn, produces encoded status information on line 126. The transceiver 110 receives the encoded status information and transmits a digital data message to the second portable unit 200 via the antenna 114.

The ON-OFF-REST switch 116 (hereinafter referred to as switch 116) is connected to the microprocessor 108 via line 132. The switch 116 is preferably a three position switch. When the switch is in the OFF position, the unit 100 is off and cannot receive or transmit data. When the switch 116 is in the ON position, the unit 100 operates in a normal manner, which is discussed below. As will become better understood from the following discussion, when the switch 116 is in the REST position at least one of the sensors 102 is disabled. When the switch 116 is in the REST position the unit 100 continues to operate as if the switch 116 was in the ON position, with the exception of the sensors 102 that are disabled.

The second portable unit 200 is identical to the first portable unit 100 discussed above. More specifically, the second portable unit 200 comprises: one or more sensors 202, a manual alarm switch 204, a power supply 206, a microcomputer 208, a digital transceiver 210, an alarm 212, an ON-OFF-REST switch 216, and an antenna 214. The power supply 206 supplies power to the microcomputer 208, the transceiver 210 and the alarm 212 via line 224. The microcomputer 208 receives sensor input signals from the sensors 202 via line 220 and a manual alarm input signal from the manual alarm switch via line 222. The microcomputer 208, in turn, produces encoded status information on line 226. The transceiver 210 receives the encoded status information and transmits a digital data message to the first portable unit 100 via antenna 214.

The ON-OFF-REST switch 216 (hereinafter referred to as switch 216) is connected to the microprocessor 208 via line 232. The swich 216 is preferably a three position switch that controls the unit 200 in a manner similar to that discussed above for the switch 116 and the unit 100.

Microcomputers 108 and 208 are preferably identical to the microcomputer 60 discussed above and illustrated in FIG. 6. Likewise, the power supplies 106 and 206 are, preferably, identical to the power supply 69 (FIG. 6) and the manual alarm switches 104 and 204 are, preferably, identical to the manual input 62 (also FIG. 6). The digital transceivers 110 and 210 are, preferably, conventional digital transceivers and operate substantially the same as the digital radio transmitter 63 and receiver 67 discussed above and illustrated in FIG. 6. The alarms 112 and 212, preferably, include visual and audible alarms substantially the same as the beeper 65 and LED 66 also noted above and illustrated in FIG. 6. Accordingly, these elements of the present invention are not discussed below in further detail.

The sensors 102 and 202 may include a motion sensor identical to the motion sensor 45 discussed above and illustrated in FIG. 5. The sensors 102 and 202 may also include a motion and position sensing switch identical to the switch 10 discussed above and illustrated in FIGS. 1–3. In any event, the motion sensor and/or the motion and position sensing switch may, in accordance with an actual working embodiment of the present invention, be disabled by activating the switches 116 and 216. Preferably, other functions of the units 100 and 200 are unaffected by the switches 116 and 216. As noted above, the sensors 102 and 202 may also include other types of sensing devices, such as a gas detector or a heart monitor, for example. Furthermore, the sensors 102 and 202 may include multiple sensing devices. The units 100 and 200 may also function without sensors 102 and 202, such that microcomputers 108 and 208 receive only the input signals from the manual alarm switches 104 and 204, respectively.

The digital data message transmitted by the first portable unit 100 is received by the transceiver 210 in the second portable unit 200 via the antenna 214. The microcomputer 208 receives the encoded status information via line 228. The microcomputer 208 decodes the status information and, if appropiate, sends an alarm signal to the alarm 212 via line 230. Similarly, the first portable unit 100 receives a digital data message from the second portable unit 200 via the antenna 114. The microcomputer 108 receives the encoded status information on line 128 and decodes the status information. If appropriate, the microcomputer 108 sends an alarm signal to the alarm 112 via line 130. As will become better understood from the following discussion, the microcomputers 108 and 208, preferably, produce different alarm signals for different alarm conditions indicated by the status information. Accordingly, the alarms 112 and 212, preferably, produce different alarms related to the different alarm signals.

If an emergency alarm condition exists, which is determined by the input signals on lines 120 and 122 for the unit 100, and on lines 220 and 222 for the unit 200, the microcomputer 108 and 208 also send alarm signals to their respective alarms 112 and 212. For example, if a user activates the manual alarm switch 104 in the first portable unit 100, the microcomputer 108 encodes this manual alarm signal into a digital data message that is transmitted to the second portable unit 200 and an alarm is produced at the second portable unit 200. The microcomputer 108 in the first portable unit 100 also sends an alarm signal to the alarm 112 in the first portable unit 100 via line 130. The alarm in the first portable unit 100 informs the worker that he has initiated an emergency alarm. The microcomputer 108 also monitors the power supply 106 and alerts the worker wearing the first portable unit 100 if a low power supply voltage exists. More specifically, the microcomputer 108 produces an alarm signal on line 130 if a low power supply voltage is detected on line 124. Likewise, the microcomputer 208 in the second portable unit 200 monitors the power supply voltage on line 224 and produces an alarm signal on line 230 if a low power supply voltage is detected.

Preferably, the units 100 and 200 permit false alarms to be cleared before they are transmitted to the other unit. A delay (e.g., 5 seconds) permits false alarm input signals to be cleared by a worker wearing the transmitting unit. For example, if a worker wearing unit 100 inadvertently activates the manual alarm switch 104, an alarm signal will be produced on line 122. The unit 100 will delay (for an appropriate period of time) encoding the signal and transmitting an emergency alarm condition in the data message to allow the worker to clear the false alarm. The false alarm may be cleared by turning the unit 100 off (via the switch 116) and then turning the unit 100 back on. The other unit 200 works similarly.

Figure 12:
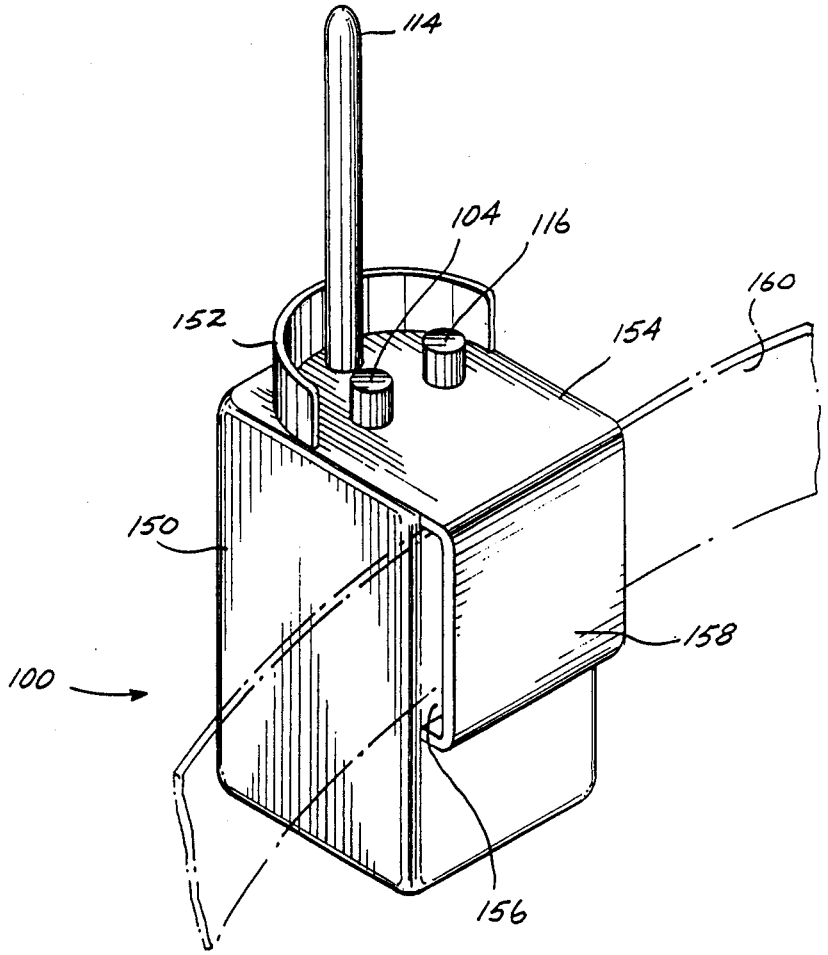
FIG. 12 is a perspective view of a portable unit suitable for use in the system depicted in FIG. 11; and, FIGS. 13 and 14 are flow charts for the buddy system illustrated in FIG. 11.

FIG. 12 is a perspective view of one preferred embodiment of the first portable unit 100 discussed above. The second portable unit 200 is not depicted in FIG. 12 for purposes of clarity. Accordingly, it is to be understood that the various features illustrated in FIG. 12 and discussed below for the first portable unit 100 are identical to the respective features of the second portable unit 200. The first portable unit 100 has a housing 150 that is, preferably, made of a rugged material, such as a high impact, shock resistant plastic, for example. However, other suitable materials may also be used. The antenna 114, the manual alarm switch 104, and the ON-OFF-REST switch 116, preferably, extend from a top surface 154 of the unit 100. A guard 152, preferably, extends above the top surface 154 and at least partially encloses the antenna 114 and the switches 104 and 116. A belt loop 156 is formed by a bracket 158 attached to, or formed by, the housing 150. A worker's belt 160 passes through the belt loop 156, thus, making it easy for the worker to wear the first portable unit 100 while performing a job task. The bracket 158 may be made of a rigid material similar to the housing 150 or may be made of another type of material, such as flexible strapping material, for example.

Figure 13:
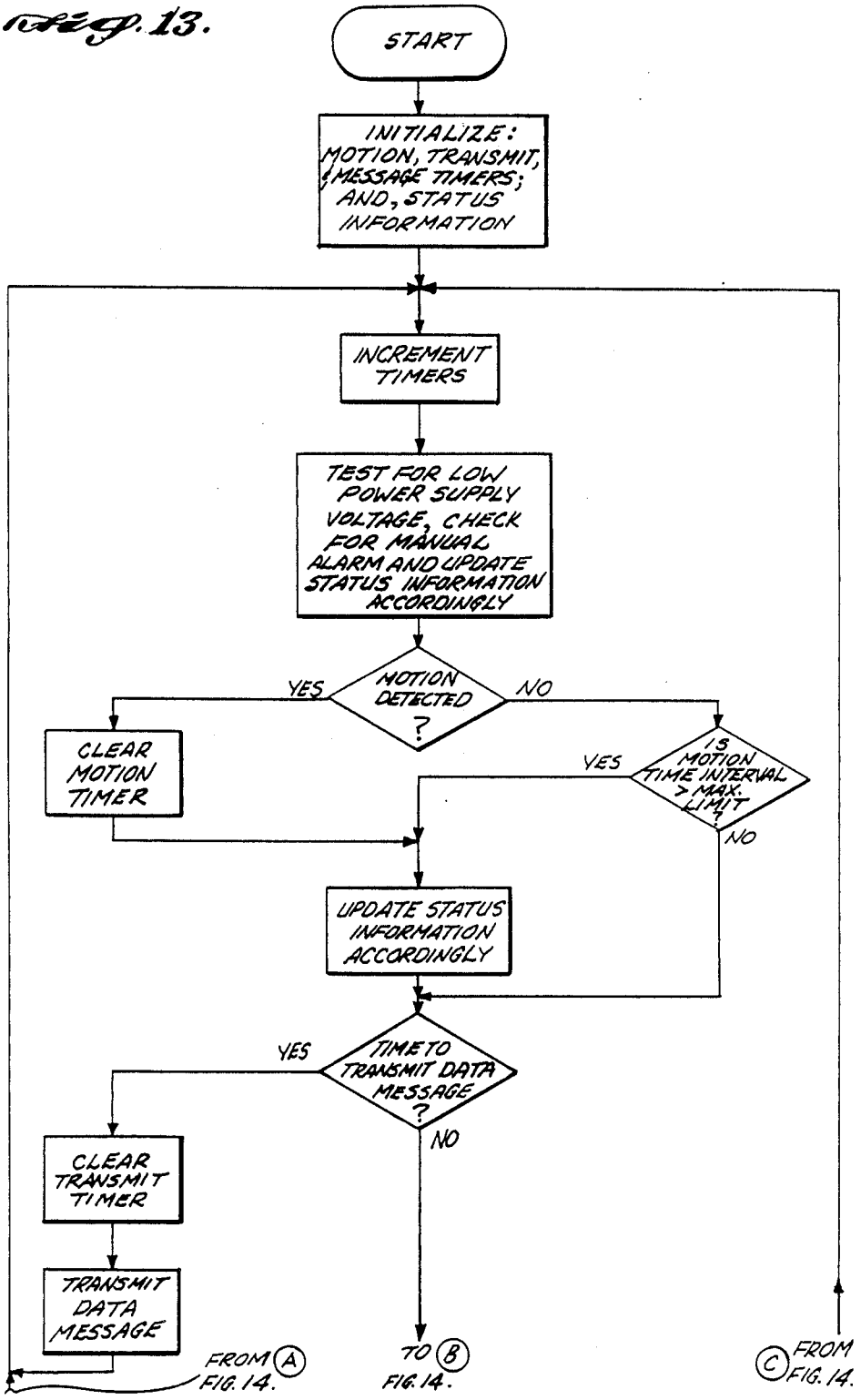
Figure 14:
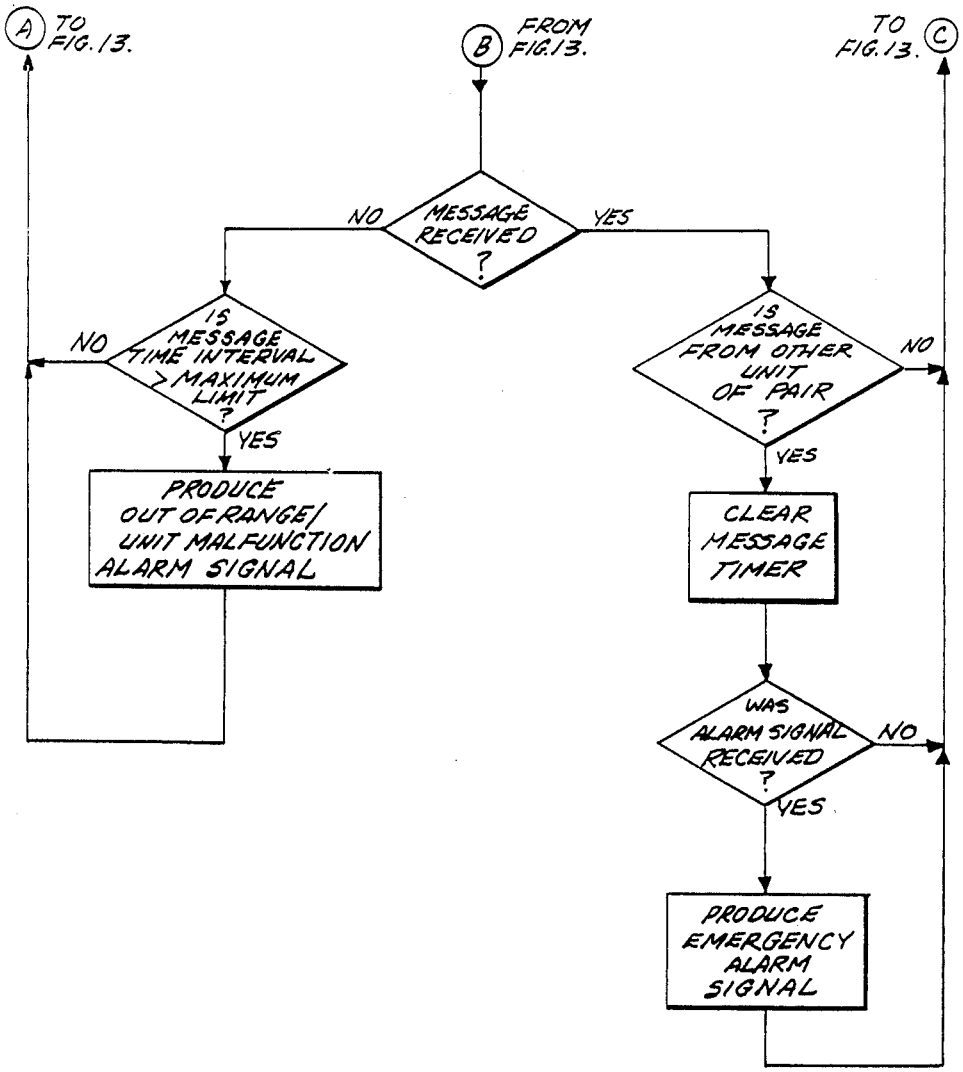

FIGS. 13 and 14 are information flow charts for the buddy system configuration of the personal security communication system illustrated in FIG. 11 and discussed above. More specifically, the flow charts represent the functional steps of a program that controls the microcomputers 108 and 208. The information flow charts illustrated in FIGS. 13 and 14 are identical for both units 100 and 200 in the unit pair 98. Accordingly, for purposes of clarity, the flow charts illustrated in FIGS. 13 and 14 are described below for the first portable unit 100.

The system becomes operational when one or both of the units 100 or 200 in the buddy system are turned on. The start block at the top of FIG. 13 represents the first portable unit 100 being turned on. Once the unit 100 has been turned on, the program instructs the microcomputer 108 to initialize various timers and the status information associated with the unit 100. More specifically, a motion timer, a transmit timer and a message timer are initialized. As will become better understood from the following discussion, the transmit timer regulates the time interval between transmissions of digital data messages to the other unit 200. The motion timer monitors the time interval during which no movement is detected by the first portable unit 100. The message timer monitors the time interval between consecutive data messages transmitted by the other unit 200. Also during this step, the status information is initialized, so that, for example, any prior emergency alarm conditions are cleared. After the initialization step, each of the timers is incremented and the program proceeds to the next step.

Once the timers have been incremented, the program instructs the microcomputer 108 to perform a power supply low voltage test. As noted above, if the microcomputer 108 determines that the power supply voltage is low (i.e., below a predetermined threshold level) an alarm signal is applied to the alarm 112 in the first portable unit 100. In accordance with the preferred embodiment of the invention, this power supply low voltage alarm is not transmitted to the second portable unit 200. During this step the program also instructs the microcomputer 108 to determine whether a manual alarm has been initiated. If the microcomputer 108 determines that a manual alarm has been initiated (i.e., detects a manual alarm signal on line 122), the status information is updated to reflect the emergency alarm condition.

Next, and in accordance with a preferred embodiment of the invention, the program instructs the microcomputer to determine whether there has been movement by the user or whether a lack-of-motion alarm signal should be produced. More specifically, the microcomputer 108 receives motion sensor signals from a motion sensor, such as the motion sensor 45 illustrated in FIG. 5, for example. The motion sensor 45 produces a motion sensor signal each time movement of the worker is detected. When a motion sensor signal is received by the microcomputer 108, the motion timer is cleared and the status information updated accordingly. If the microcomputer 108 does not sense a motion sensor signal, the program then determines whether the time interval measured by the motion timer has exceeded a maximum allowable time limit (i.e., a predetermined time interval, such as one minute, for example). If the time interval measured by the motion timer exceeds the maximum allowable time limit, a lack-of-motion alarm condition exists. As a result, the status information is updated to include emergency alarm information that reflects the lack-of-motion alarm condition. Once the status information has been updated, the program proceeds to the next step, which is discussed below. If the microcomputer 108 does not sense a motion sensor signal and the time interval measured by the motion timer does not exceed the maximum allowable time limit, the program bypasses the status information update step and proceeds directly to the next step.

Next, the program determines whether it is time to transmit the current status information as a data message to the second portable unit 200. More specifically, if the time interval measured by the transmit timer equals or exceeds a predetermined time limit, such as, four and one-half seconds, for example, the program clears the transmit timer and transmits the current status information as a data message to the second portable unit 200. Once the data message has been transmitted, the program returns to increment the cleared transmit timer and the and message and motion timers (FIG. 13). If the program determines that it is not time to transmit the status information, that is, if the time interval measured by the transmit timer since the last transmitted message is less than the predetermined time limit, the first portable unit 100 does not transmit the status information as a data message and the program proceeds to the next step.

Turning to FIG. 14, once the program has determined it is not yet time to transmit the data message, the program determines whether the first portable unit 100 has received a digital data message from the second portable unit 200. As noted above, the data message transmitted by the second portable unit 200 includes encoded status information associated with the second portable unit 200. More specifically, the encoded status information from unit 200 includes an identification number for the second portable unit 200 and alarm condition information associated with the second portable unit 200. If a data message has not been received by the first portable unit 100, the program determines whether it has been too long since the last data message was received. More specifically, if the time interval monitored by the message timer does not exceed a maximum allowable time limit (such as two and one-half minutes, for example), the program returns to increment the timers (FIG. 13). If the time interval monitored by the message timer does exceed the maximum allowable time limit, the program instructs the microcomputer 108 to produce an unit out-of-range/unit malfunction alarm signal. The alarm signal is applied to the alarm 112 (FIG. 11). Once the alarm signal has been produced, the program returns to increment the timers (FIG. 13).

If a data message has been received by the first portable unit 100, the program determines whether the received message was transmitted from the second portable unit 200 or from some other unit. This is done by the first portable unit 100 when it decodes the data message and compares the unit identification number in the received data message with the identification number of the other unit in the pair (i.e., the second portable unit 200). If the identification number is not the same as the second portable unit identification number, then the message was transmitted from another unit and the message is ignored by the first portable unit 100. In this situation the program returns to increment the timers (FIG. 13). If the program determines the received message is from the second portable unit 200 (i.e., the received data message contains the second portable unit identification number), the message timer in unit 100 is cleared and the program determines whether the data message included emergency alarm information. If emergency alarm information was included in the received data message, the program instructs the microcomputer 108 to produce an emergency alarm signal. The emergency alarm signal is applied to the alarm 112 (FIG. 11). Next, the program returns to increment the timers (FIG. 13). If the program determines that emergency alarm information was not included in the received data message, the program returns to increment the timers (FIG. 13). The program steps are repeated in the manner illustrated in FIGS. 13 and 14 and discussed above until the first portable unit 100 is turned off.

As noted above, on physical embodiment of the present invention includes a rest feature that disables at least one of the sensors 102 illustrated in FIG. 11 and discussed above (such as the motion sensor 45, for example). More specifically, if the first portable unit 100 is placed in a rest mode (i.e., if the switch 116 is placed in the REST position, FIG. 11), the first portable unit 100 will continue to update status information and transmit data messages to the second portable unit 200 and receive data messages from the second portable unit 200. However, while in the rest mode, the first portable unit 100 will not transmit emergency alarm information indicating a lack-of-motion alarm condition to the second portable unit 200. Thus, with the first portable unit 100 in the rest mode, the worker wearing the first portable unit 100 may stop working (i.e., rest) and not send false lack-of-motion alarm signals to the second portable unit 200 while continuing to monitor the second portable unit 200.

As can be readily appreciated from the foregoing description, the invention provides a personal security communication system. While a preferred embodiment of the invention has been illustrated and described herein, it is to be understood that, within the scope of the appended claims, various changes can be made. For example, more than two units can be configured to operate together in a buddy system. Also, the units in a buddy system may communicate with a base station, in addition to communicating with each other. Furthermore, processors other than the microcomputers discussed above may be used. Hence, the invention may be practiced otherwise than as specifically described herein.

The embodiments of the invention in which an exclusive property or privilege is claimed are defined as follows:

1. A personal security communication system configured to operate as a buddy system, said system comprising:

(a) a first portable unit for producing a first status signal and receiving a second status signal, said first portable unit transmitting said first status signal as a radio frequency carrier signal modulated with data messages, said first portable unit producing an alarm when said first status signal includes emergency alarm information, and said first portable unit also producing an alarm when said second status signal includes emergency alarm information, said first portable unit further producing an alarm when said second status signal is not received for a predetermined period of time; and, (b) a second portable unit for producing said second status signal and receiving said first status signal, said second portable unit transmitting said second status signal as a radio frequency carrier signal modulated with data messages, said second portable unit producing an alarm when said first status signal includes emergency alarm condition information and said second portable unit also producing an alarm when said second status signal includes emergency alarm condition information, said second portable unit further producing an alarm when said first status signal is not received for a predetermined period of time.

2. The system claimed in claim 1, wherein said first portable unit comprises:

(a) first signaling means;

(b) first receiving means for receiving said second status signal;

(c) first processing means for receiving and encoding signal information from said first signaling means and producing said first status signal indicative of said signal information and for receiving and decoding said second status signal;

(d) first transmitting means for transmitting said first status signal as a first data message; and, (e) first alarm means for producing an alarm when said first status signal includes said emergency alarm information and for producing an alarm when said second status signal includes said emergency alarm information, said first alarm means further producing an alarm when said second status signal is not received for said predetermined period of time.

3. The system claimed in claim 2, wherein said second portable unit comprises:

(a) second signaling means;

(b) second receiving means for receiving said first status signal;

(c) second processing means for receiving and encoding signal information from said second signaling means and producing said second status signal indicative of said signal information and for receiving and decoding said first status signal;

(d) second transmitting means for transmitting said second status signal as a second data message; and, (e) second alarm means for producing an alarm when said first status signal includes said emergency alarm information and for producing an alarm when said second status signal includes said emergency alarm information, said second alarm means further producing an alarm when said first status signal is not received for said predetermined period of time.

4. The system claimed in claim 3, wherein said first signaling means of said first portable unit comprises a first manual alarm switch that produces a first manual alarm signal when activated, said first manual alarm signal causing said first processing means to produce said first status information signal including emergency alarm information related to said first manual alarm signal, and wherein said second signaling means of said second portable unit comprises a second manual alarm switch that produces a second manual alarm signal when activated, said second manual alarm signal causing said second processing means to produce said second status information signal including emergency alarm information related to said second manual alarm signal.

5. The system claimed in claim 4, wherein said first signaling means of said first portable unit further comprises a first motion sensor that senses motion of said first portable unit, produces first motion sensor signals responsive to the motion of said first portable unit and provides said first motion sensor signals to said first processing means in said first portable unit, and wherein said second signaling means of said second portable unit further comprises a second motion sensor that senses motion of said second portable unit, produces second motion sensor signals responsive to the motion of said second portable unit and provides said second motion sensor signals to said processing means in said second portable unit.

6. The system claimed in claim 5, wherein said first processing means of said first portable unit comprises first transmit timing means for controlling the transmission of said first status signal such that said first status signal is transmitted at regular intervals determined by said first transmit timing means, and wherein said second processing means of said second portable unit comprises second transmit timing means for controlling the transmission of said second status signal, such that said second status signal is transmitted at regular intervals determined by said second transmit timing means.

7. The system claimed in claim 6, wherein said first processing means of said first portable unit further comprises first motion timing means for timing intervals between consecutive first motion sensor signals produced by said first motion sensor in said first portable unit, said first portable unit producing said first data message including emergency alarm information indicating lack of motion of said first portable unit when said interval between said consecutive first motion sensor signals exceeds a predetermined time interval, and wherein said second processing means of said second portable unit further comprises second motion timing means for timing intervals between consecutive second motion sensor signals produced by said second motion sensor in said second portable unit, said second portable unit producing said second data message including emergency alarm information indicating lack of motion of said second portable unit when said interval between said consecutive second motion sensor signals exceeds a predetermined time interval.

8. The system claimed in claim 7, wherein said first processing means of said first portable unit further comprises first message timing means for timing intervals between consecutive second data messages transmitted by said second portable unit, said first portable unit producing an alarm indicating a communication failure between said first and second portable units when said interval between said consecutive second data messages exceeds a predetermined time interval, and wherein said second processing means of said second portable unit further comprises second message timing means for timing intervals between consecutive first data messages transmitted by said first portable unit, said second portable unit producing an alarm indicating a communication failure between said first and second portable units when said interval between said consecutive first data messages exceeds a predetermined time interval.

9. The system claimed in claim 8, wherein said first portable unit includes a first switch that disables said first motion sensor and, wherein said second portable unit includes a second switch that disables said second motion sensor.

10. The system claimed in claim 9, wherein said first and second alarm means include both visual and audible alarm devices.

11. The system claimed in claim 1, wherein said first and second portable units each include a self-contained power supply.

12. The system claimed in claim 11, wherein said first and second portable units may be mounted on belts worn by workers using said first and second portable units.

13. A portable unit for use in a personal security communication system comprising:

a housing adapted to be worn by an individual;

a signaling unit integral with said housing including a manually actuatable switch for producing an alarm signal and a motion sensor including an enclosure having an open end, a base covering said open end, a pressure sensitive electrical means on said base facing said enclosure and a mass in said enclosure adapted to move freely therein when said housing is in motion such that movement over said sensing means results in the production of a motion signal:

a processing means connected to said signalling unit for receiving said alarm signal and said motion signal and for producing status information signals of said received signals including a processor alarm signal which is produced when said manual alarm signal is produced or when said motion signal indicates said housing has been motionless for a selected amount of time;

a transmitting means connected to said processing means for receiving said status information signals and for transmitting said status information signals as data messages;

an alarm connected to said processing means for receiving said processor alarm signal and actuatable in response to receiving said processor alarm signal; and, a power supply coupled to supply power to said processing means, said transmitting means, and said alarm.

14. The portable unit claimed in claim 13, wherein said pressure sensitive electrical sensing means comprises a piezoelectric element and said mass comprises a ball bearing.

15. A portable unit for use in a personal security communication system comprising:

a housing adapted to be worn by an individual;

a signaling unit integral with said housing including a manually actuatable switch for producing an alarm signal and a motion sensor for generating a motion signal whenever said housing is in motion;

a processing means connected to said signalling unit for receiving said alarm signal and said motion signal and for producing status information signals of said received signals including a processor alarm signal which is asserted when said manual alarm signal is asserted or when said motion signal indicates said housing has been motionless for a selected amount of time;

a transceiver connected to said processing means transmitting and receiving status information signals from and to said processor means, wherein said status information signals are transmitted and received in the form of data messages;

an alarm connected to said processing means for receiving said processor alarm signal and actuatable in response to receiving said processor alarm signal; and, a power supply coupled to supply power to said processing means, said transmitting means, and said alarm.

16. The portable unit claimed in claim 15 wherein said processor means is a microcomputer.

17. A personal safety unit comprising:

a housing adapted to be worn by an individual;

a motion detector integrally attached to said housing including:

a motion sensor including two mechanical elements arranged such that one said mechanical element moves in and out of contact with the other said mechanical element when said housing is in motion and such that said sensor produces a motion signal indicative of contact status of said mechanical elements; and a detect circuit coupled to said motion sensor for receiving said motion signal, monitoring same, and producing an alarm signal when said housing is motionless for a selected amount of time;

an alarm device integral with said housing and connected to receive said alarm signal and responding to said alarm signal by producing an alarm; and a transmitter integrally attached to said housing for receiving said alarm signal and, in response to an alarm signal, transmitting a signal indicating said alarm signal was produced.

18. The personal safety unit of claim 17, wherein said motion sensor includes a capped enclosure integral with said housing, a mass disposed in said enclosure and adapted for free movement therein, and a sensing means integral with said enclosure for producing a signal representative of the movement of said mass.

19. The personal safety unit of claim 18, wherein said sensing means comprises a piezoelectric element attached to said enclosure and said mass is a ball bearing.

20. The personal safety unit of claim 19, wherein said detect circuit includes a processor for monitoring said motion signal and producing said alarm signal when said housing has been motionless for a selected amount of time.

21. The personal safety unit of claim 17, wherein said detect circuit includes a processor for monitoring said motion signal and producing said alarm signal when said housing has been motionless for a selected amount of time.

22. The personal safety unit of claim 21, further including a receiver for receiving incoming status information, and wherein said processor is connected to said receiver for receiving said incoming status information and, in response to selected incoming status information, produces an alarm signal.

23. The personal safety unit of claim 17, wherein:

said motion sensor is responsive to said housing motion such that said sensor produces a first motion signal when said housing is in a first position and negates said first position signal when said housing is in a second position; and said detect circuit monitors said sensor signal and, when said first motion signal is produced for more than said selected length of time, produces said alarm signal and, when said first position signal is negated for more than said selected length of time, produces said alarm signal.

24. The personal safety unit of claim 23, wherein said motion switch comprises an enclosure forming a cavity, said enclosure further having two spaced-apart conductive elements and a conductive mass in said cavity adapted to move therein such that when said housing is in said first position said conductive element establishes an electrical connection between said enclosure conductive regions, and when said housing is in said second position said conductive element is spaced from said enclosure conductive regions so as to break electrical connections established therebetween.

25. The personal safety unit of claim 23, wherein said detect circuit includes a processor for monitoring said motion signal and asserting said alarm signal when said housing has been motionless for a selected amount of time.

26. A personal safety unit comprising:

a housing adapted to be worn by an individual;

a motion detector integrally attached to said housing including:

a motion sensor including two mechanical elements arranged such that one said mechanical element moves in and out of contact with the other said mechanical element when said housing is in motion and such that said sensor produces a motion signal indicative of contact status of said mechanical elements; and a detect circuit coupled to said motion sensor for receiving said motion signal, monitoring same, and producing an alarm signal when said housing is in motionless for a selected amount of time; and an alarm device integral with said housing and connected to receive said alarm signal and responding to said alarm signal by producing an alarm.

27. A personal safety unit comprising:

a housing adapted to be worn by an individual;

a motion detector integrally attached to said housing including:

a motion sensor including two mechanical elements arranged such that one said mechanical element moves in and out of contact with the other said mechanical element when said housing is in motion and such that said sensor produces a motion signal indicative of contact status of said mechanical elements; and a detect circuit coupled to said motion sensor for recieving said motion signal, monitoring same, and producing an alarm signal when said housing is motionless for a selected amount of time; and a transmitter integrally attached to said housing for receiving said alarm signal and, in response to an alarm signal, transmitting a signal indicating said alarm signal was produced.

28. The personal safety unit of claim 27, further including an alarm integrally attached to said housing connected to receive said detect circuit alarm signal and responding to said alarm signal by producing an alarm.

* * * * *

UNITED STATES PATENT AND TRADEMARK OFFICE

CERTIFICATE OF CORRECTION

PATENT NO. : 4,978,946

DATED : December 18, 1990

INVENTOR(S) : K. Nordholm et al.

It is certified that error appears in the above-identified patent and that said Letters Patent is hereby corrected as shown below:

| Column | Line | |
|---|---|---|
| [57], Abstract | 10 | Delete "indentification" and insert therefor --identification-- |
| [57], Abstract | 13 | Delete "(1102" and insert therefor --(102-- |
| 1 | 33 | Delete "situation, and" and insert therefor --situation and,-- |
| 1 | 46 | Delete "buddy" and insert therefor --partner-- |
| 2 | 50 | Delete "includes" and insert therefor --include-- |
| 4 | 21 | Delete "circuit" and insert therefor --switch-- |
| 4 | 40 | Delete "switch" and insert therefor --switches |
| 4 | 42 | Delete "switch" and insert therefor --switches-- |
| 4 | 64 | Delete "consists" and insert therefor --consist-- |
| 7 | 58 | Delete "appropiate" and insert therefor --appropriate-- |
| 10 | 15 | After "the" delete "and" |
| 10 | 44 | After "an" delete "unit" |
| 11 | 11 | Delete "on" and insert therefor --one-- |
| 13 | 58 | Delete "and," and insert therefor --and-- |
| 14 | 15 | Delete "signalling" and insert therefor --signaling-- |
| 14 | 45 | Delete "signalling" and insert therefor --signaling-- |
| 16 | 14 | Delete "asserting" and insert therefor --producing-- |
| 16 | 30 | After "is" delete "in" |

UNITED STATES PATENT AND TRADEMARK OFFICE

CERTIFICATE OF CORRECTION

PATENT NO. : 4,978,946

DATED : December 18, 1990

INVENTOR(S) : K. Nordholm et al

It is certified that error appears in the above-identified patent and that said Letters Patent is hereby corrected as shown below:

| Column | Line | |
|---|---|---|
| 16 | 47 | Delete "recieving" and insert therefor --receiving-- |

Signed and Sealed this

Thirtieth Day of June, 1992

*Attest:*

DOUGLAS B. COMER

*Attesting Officer*

*Acting Commissioner of Patents and Trademarks*